United States Patent [19]

Aigo

[11] 4,339,319

[45] Jul. 13, 1982

[54] APPARATUS FOR PLATING SEMICONDUCTOR WAFERS

[76] Inventor: Seiichiro Aigo, 3-15-13, Negishi, Daito-ku, Tokyo, Japan

[21] Appl. No.: 214,638

[22] Filed: Dec. 10, 1980

[30] Foreign Application Priority Data

Aug. 16, 1980 [JP] Japan ..... 55-116251[U]

[51] Int. Cl.[3] ..... C25D 17/06; C25D 17/04

[52] U.S. Cl. ..... 204/224 R; 204/275; 204/297 R

[58] Field of Search ..... 204/224 R, 275, 237, 204/297 R, 297 W.

[56] References Cited

U.S. PATENT DOCUMENTS

| | | | |
|---|---|---|---|
| 2,475,434 | 7/1949 | Moss | 204/297 W |
| 2,502,495 | 4/1950 | Waterman | 204/237 |
| 2,721,839 | 10/1955 | Taylor | 204/237 X |
| 4,126,533 | 11/1978 | Lukyanchikov et al. | 204/224 R |

FOREIGN PATENT DOCUMENTS

| | | | |
|---|---|---|---|
| 54-19649 | 2/1979 | Japan | 204/297 R |
| 1549862 | 8/1979 | United Kingdom | 204/224 R |

*Primary Examiner*—Delbert E. Gantz
*Assistant Examiner*—Donald R. Valentine
*Attorney, Agent, or Firm*—McGlew and Tuttle

[57] ABSTRACT

An apparatus for applying a bump-plating on one surface of a semiconductor wafer, which comprises a plurality of cup-shaped plating basins and a plurality of holders, each of the holders being engageable with a relevant one of the basins to set a semiconductor wafer horizontally, in which the underside surface to be plated of the wafer is contacted with plating liquid vertically blown up, the top peripheral portion of each said basin is of a curved convex cross-sectional form to thereby permit the plating liquid to flow over said top peripheral portion of the basin in essentially laminar stream condition by surface tension of the plating liquid.

5 Claims, 6 Drawing Figures

APPARATUS FOR PLATING SEMICONDUCTOR WAFERS

BACKGROUND OF THE INVENTION

This invention relates to an improvement of an apparatus for plating semiconductor wafers for applying a bump-plating with gold, silver or the like on one surface of the wafers.

In a prior art for plating one surface of a semiconductor wafer, it requires surplus plating steps and materials relating thereto, because in the process a semiconductor wafer to be plated is held with pins at several positions of the periphery of wafer to be dipped in a plating liquid, and it is required to coat a coating such as photoresist, wax or the like on a wafer surface not to be plated and thus to remove the coating from the wafer surface after the plating. Recently, in order to solve the above described disadvantages in the prior art, an apparatus for plating semiconductor wafers has been developed which comprises a plurality of cup-shaped plating basins secured horizontally within a container and a plurality of holders secured in a cover which is movable relative to and above said container, each holder being aligned and engageable with a relevant one of the plating basins to set a semiconductor wafer therebetween, and in which plating liquid is blown up from down to up against the wafers set in the respective basins. However, since in the apparatus the blown up plating liquid tends to turn up to the upside surface of semiconductor wafer, it is necessary that the bottom portion of each holder is formed with an annular nozzle to prevent the upside surface of wafer from contacting with plating liquid by blowing out of a gas through the nozzle. If the blowing of gas is not applied uniformly on the upside wafer surface, plating liquid is apt to turn up and thereby to contact with the wafer surface not to be plated.

SUMMARY OF THE INVENTION

Therefore, an object of the present invention is to provide an apparatus for plating semiconductor wafers comprising a plurality of cup-shaped plating basins and a plurality of holders in combination with the basins, which enables to prevent a wafer surface not to be plated from contacting with plating liquid even without usage of any gas blowing.

To achieve the above described object of the invention, an apparatus for plating semiconductor wafers according to the present invention, which comprises a plurality of cup-shaped plating basins secured horizontally within a container and a plurality of holders secured in a cover which is movable relative to and above said container, each holder being aligned and engageable with a relevant one of the plating basins to set a semiconductor wafer therebetween, is characterized in that the top peripheral portion of each said basin is of a curved convex cross-sectional form to thereby permit plating liquid, which is blown up from down to up, to flow over said top peripheral portion of the basin in essentially laminar stream condition by surface tension of the plating liquid.

BRIEF DESCRIPTION OF THE DRAWINGS

In the detailed description of the preferred embodiments of the present invention set forth below, reference is made to the accompanying drawings in which.

DESCRIPTION OF THE PREFERRED EMBODIMENTS

Figure 1:
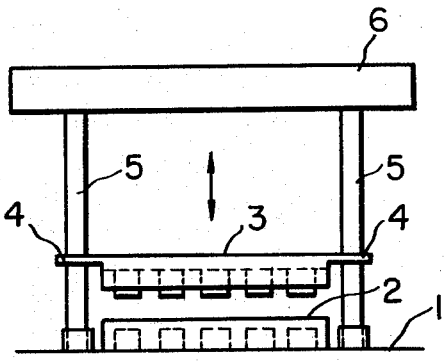
FIG. 1 is a side elevational view showing substantially the entirety of an apparatus for plating semiconductor wafers embodied by the present invention.
Figure 2:
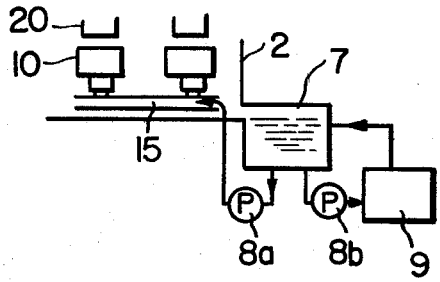
FIG. 2 is a schematic view of a plating system of the apparatus.

Referring now to FIG. 1, an apparatus according to the invention includes a container 2 mounted on a base 1 and a cover 3 which is vertically movable above the container. This cover 3 is guided vertically with opposite flanged portions 4 thereof, openings formed in the respective flanged portions being movably engaged with relevant guide bars 5. These guide bars are secured between the base 1 and a ceiling 6. A system relating to the apparatus, as shown in FIG. 2, includes a tank 7 for receiving plating liquid, a pair of pumps 8*a* and 8*b* and a filter 9. In this system, plating liquid discharged from container 2 is fed to filter 9 by pump 8*b* and cleaned through filter 9, then returned to tank 7 and again introduced into the respective plating basins in the container 2 by pump 8*a*. The container includes therein a plurality of essentially cup-shaped plating basins 10 disposed on the same level, for example, 5 lines×5 rows=25 of the basins being included. Also, cover 3 has the same number of holders 20 secured thereto in position corresponding to the respective basins 10.

Figure 3:
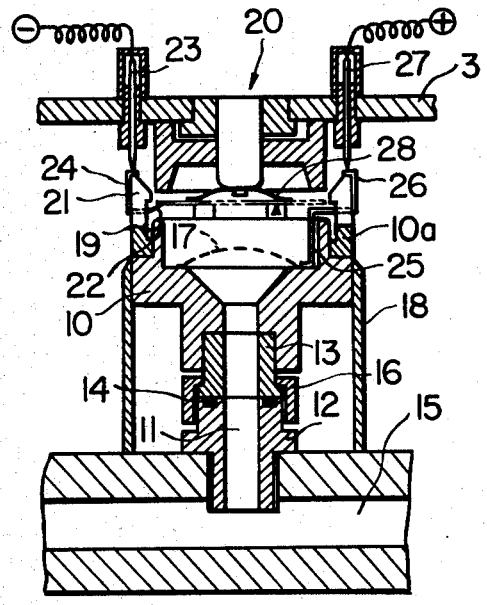
FIG. 3 is a vertical sectional view of a set of a plating basin and a relevant holder provided thereabove contained in the apparatus.
Figure 4:
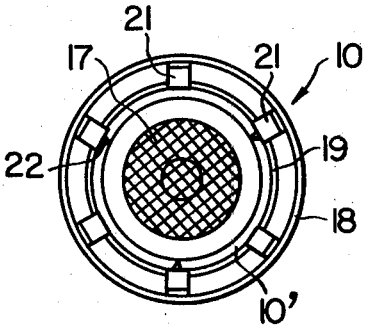
FIG. 4 is a plan view of a plating basin shown in FIG. 3.

Each plating basin 10 is preferably made of polypropylene or the like, and as shown in FIG. 3, the axis of the basin 10 is vertical. Lower portion of the basin is of a tubular form provided with a central passage 11. The passage 11 is connected at the lowermost portion thereof with a common conduit 15 disposed in container 2 by means of adapter 12, sleeve 13 and O-ring 14 located therebetween. A plating liquid is adapted to be blown up through common conduit 15 and passage 11. 16 denotes a cap nut which serves to connect adapter 12 with sleeve 13. A preferably mesh-shaped anode 17 is provided on the top portion of passage 11. A cylindrical skirt 18 is preferably provided which surrounds outer periphery of lower portion of basin 10.

Figure 5:
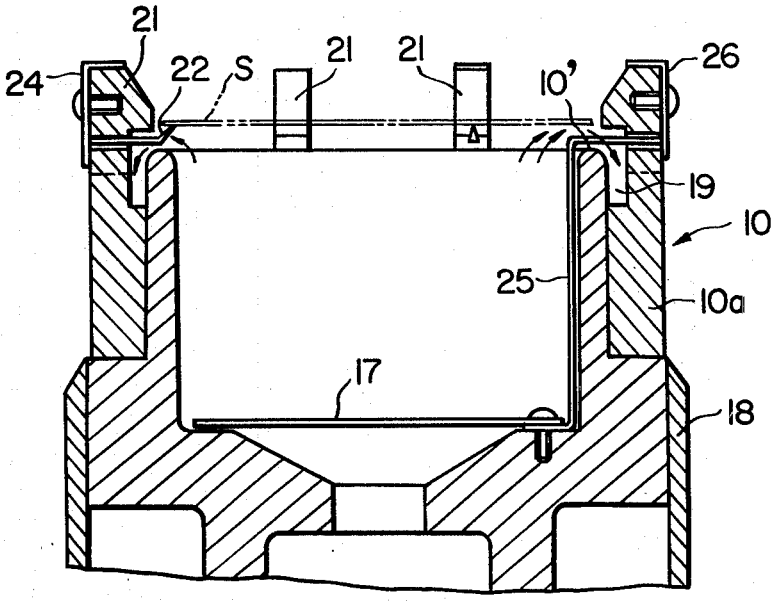
FIG. 5 is an enlarged vertical sectional view of a portion of a plating basin showing essential portion of the invention.

An apparatus according to an embodiment of the invention, as shown in FIGS. 3 and 5, each basin 10 is provided with a wafer-holder 10*a* surrounding the uppermost portion of the basin, and the top peripheral portion of each basin 10 is of a curved convex cross-sectional form such as an arc-shaped section. An annular gap 19 is defined between the outer periphery of the uppermost portion of basin 10 and inner periphery of the wafer-holder 10*a*. And a plurality of, at least three, protrusions 21 are integrally formed on the top peripheral portion of wafer-holder 10*a*. These protrusions 21 will serve to guide a semiconductor wafer S to be set in plating basin 10 as well as to support pins 22 thereon. A tip of each pin 22 is vertically or slantly upwards oriented and sharply pointed. These tips are adapted to support a semiconductor wafer S to be plated. Preferably, the inner surface of the respective protrusions 21 is slant divergently upwards. Some pins 22 will be connected to cathode, to be used as cathode in basin 10. These pins 22 are preferably made of a resin-coated lead wire, the pins 22 used as cathode being connected to lead piece 24 and in turn to cathode electrode bar 23. The anode 17 is connected through a lead wire 25 and a lead piece 26 mounted on one of the protrusions 21, to anode electrode bar 27. The bottom surface of the respective holders is preferably provided with a spring 28 to thereby resiliently hold a semiconductor wafer S.

In operation, plating liquid in the tank 7 is introduced by pump 8a into the common conduit 15 in container 2 and therefrom dispensed to the respective plating basins 10. Then the plating liquid is blown up through passage 11 of basin 10 and through anode 17 against the underside surface to be plated of a semiconductor wafer S supported on pins 22 secured in the uppermost region of basin 10, and thereafter flows out over the top peripheral portion 10' between protrusions 22. When flowing out from plating basin 10, plating liquid flows down from the basin 10 with its reaction against the underside surface of wafer and its gravity, while the curved convex form of the top portion 10' enables the plating liquid to flow over the top portion 10' of the plating basin 10 smoothly in laminar or similarly laminar stream condition by surface tension of plating liquid. Thus, this prevents plating liquid from turning up to the upside surface not to be plated of a semiconductor wafer. In addition, normally, the inner periphery of the basin 10 is of a smaller diameter than that of a semiconductor wafer to be set. A set semiconductor wafer S is resiliently held by spring 28 of holder 20 disposed thereon. The spring 28 may be a coil spring, and preferably a leaf spring. A semiconductor wafer is horizontally set in plating basin 10 in order to contact with plating liquid uniformly. In this apparatus, after flowing over the top portion 10' of basin 10, plating liquid flows down into gap 11 and therefrom flows down through spaces between protrusions 21, and then along outer peripheral surface of wafer-holder 10a and along skirt 18 into container 2. Plating liquid in container 2 is fed into tank 7. The provision of skirt 18 serves to prevent dropping of plating liquid and thus to prevent plating liquid from absorption of oxygen in air.

Figure 6:
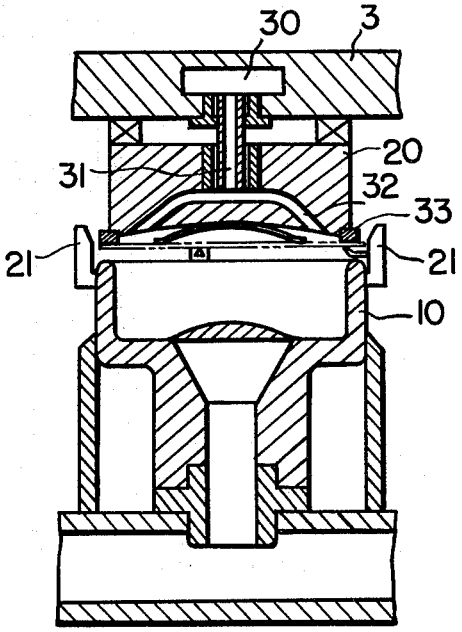
FIG. 6 is a vertical sectional view similar to FIG. 3, showing another embodiment of the invention.

In the described embodiment, the respective plating basins 10 are provided with a wafer-holder 10a which has some protrusions 21 integral therewith on the top portion of the wafer-holder. Although this arrangement is advantageous for production, assembly, maintenance, etc., such wafer-holder 10a is not always needed. Therefor, as shown in FIG. 6, the protrusions 21 will be mounted on the uppermost portion of plating basin 10 in such a way that they project upwards over the top portion 10' of basin 10. Also, while the described apparatus does not employ any blowing of gas from the respective holder 20, blowing of gas will be utilized additionally. FIG. 6 shows an embodiment which includes blowing down of a gas such as nitrogen gas, air or the like against the upside surface of a set wafer. The apparatus shown in FIG. 6 thus includes a common gas passage 30 provided in the cover 3. Each holder 20 has a gas passage 31 formed axially thereof which is communicated with the common gas passage 30. Lower end of the passage 31 is connected to an annular blow nozzle 32. Accordingly, gas introduced through gas passages 30 and 31 is blown down through nozzle 32 against the upside surface of a semiconductor wafer in order to prevent additionally plating liquid from turning up to the upside surface of wafer. 33 in FIG. 6 denotes an annular resilient member to hold outer periphery of a set semiconductor wafer.

As described above, the apparatus according to the present invention effects easy setting of semiconductor wafers and holding them suitably by pins 22 secured in plating basin 10 and by holder 20 provided thereabove. And, plating liquid can flow over the top peripheral portion of plating basin 10 to thereby prevent plating liquid from turning up to the upside surface not to be plated of a set wafer.

Therefore, the present invention effects a reliable application of plating on one surface of semiconductor wafers, and thus contributes toward an improvement in quality of plating and toward good performance of this type of plating apparatus.

The present invention may be embodied in other forms or carried out in other ways without departing from the spirit or essential characteristics thereof. The present embodiments are therefore to be considered as in all respects illustrative and not respective, the scope of the invention being indicated by the appended claims, and all changes which come within the meaning and range of equivalency are intended to be embraced therein.

I claim:

1. An apparatus for plating semiconductor wafers to bump-plate one surface of the wafers, which comprises a plurality of cup-shaped plating basins secured horizontally within a container, a plurality of holders secured in a cover which is movable relative to and above said container, each said holder being aligned and engageable with a relevant one of said plating basins to set a semiconductor wafer therebetween, the respective plating basins including cathode and anode and being provided with a plurality of protrusions at its uppermost region, at least three of said protrusions having a pin of which tip is vertically or slantly upwards oriented and sharply pointed, said pins being used as said cathode as well as the tips of pins being adapted to support a semiconductor wafer thereon, a circulating system for blowing up the plating liquid through the respective plating basins, said apparatus being characterized in that the top peripheral portion of each said basin is of a curved convex cross-sectional form to thereby permit the plating liquid to flow over said top peripheral portion of the basin in essentially laminar stream condition by surface tension of the plating liquid.

2. An apparatus for plating semiconductor wafers set forth in claim 1, wherein each said plating basin is provided with a wafer-holder which surrounds the uppermost portion of the basin and there is an annular gap defined between outer periphery of said uppermost portion of the basin and inner periphery of the wafer-holder, the respective protrusions being formed on the top peripheral portion of the wafer-holder.

3. An apparatus for plating semiconductor wafers set forth in claim 1, wherein each said holder is provided with a leaf spring for resiliently holding a semiconductor wafer.

4. An apparaus for plating semiconductor wafers set forth in claim 1, wherein inner surface of each said protrusion is upwards divergently slant.

5. An apparatus for plating semiconductor wafers set forth in claim 1, wherein a skirt of a cylindrical shape is provided on outer periphery of the lower portion of the respective plating basins in order to prevent dropping of the plating liquid.

* * * * *